US008316992B2

(12) United States Patent
Archer

(10) Patent No.: US 8,316,992 B2
(45) Date of Patent: Nov. 27, 2012

(54) METHOD AND APPARATUS FOR SECURING A SCAFFOLD TO A BUILDING

(76) Inventor: Logan Wade Archer, Thousand Oaks, CA (US)

( * ) Notice: Subject to any disclaimer, the term of this patent is extended or adjusted under 35 U.S.C. 154(b) by 991 days.

(21) Appl. No.: 11/677,439

(22) Filed: Feb. 21, 2007

(65) Prior Publication Data

US 2007/0278038 A1 Dec. 6, 2007

Related U.S. Application Data

(60) Provisional application No. 60/803,395, filed on May 30, 2006, provisional application No. 60/804,421, filed on Jun. 9, 2006, provisional application No. 60/833,379, filed on Jul. 26, 2006.

(51) Int. Cl.
*E04G 3/20* (2006.01)

(52) U.S. Cl. ..... 182/87; 248/231.91; 182/82; 182/83; 182/229

(58) Field of Classification Search ..... 182/82, 182/87, 83, 229; 248/231.91
See application file for complete search history.

(56) References Cited

U.S. PATENT DOCUMENTS

| | | | | | |
|---|---|---|---|---|---|
| 776,668 | A * | 12/1904 | Macharaceck | 182/87 |
| 1,366,920 | A * | 2/1921 | Minnis | 24/129 R |
| 2,248,348 | A * | 7/1941 | Hall | 52/426 |
| 3,150,890 | A * | 9/1964 | Sego et al. | 403/184 |
| 3,260,021 | A * | 7/1966 | Katz | 52/27 |
| 3,998,294 | A * | 12/1976 | Moeller | 182/229 |
| 4,205,497 | A * | 6/1980 | Schirm | 52/93.2 |
| 4,932,185 | A * | 6/1990 | Lebel | 52/704 |
| 5,640,824 | A * | 6/1997 | Johnson et al. | 52/578 |
| 6,427,391 | B1 * | 8/2002 | Lyons | 52/73 |
| 6,904,728 | B2 * | 6/2005 | Stutts | 52/233 |
| 2002/0000070 | A1 * | 1/2002 | VeRost et al. | 52/295 |
| 2008/0087275 | A1 * | 4/2008 | Sade et al. | 126/623 |

* cited by examiner

*Primary Examiner* — Katherine W Mitchell
*Assistant Examiner* — Daniel Cahn
(74) *Attorney, Agent, or Firm* — Hani Z. Sayed; Rutan & Tucker, LLP

(57) ABSTRACT

An anchoring system for securing a scaffold to a building includes a connection member configured to attach to a scaffold component and an anchor member. The anchor member includes a base configured to attach to at least one structural component of a building and a coupling fixedly connected to the base. The coupling is configured to receive a connection member to rigidly join the connection member to the anchor member, and thus, the scaffold to a building.

14 Claims, 19 Drawing Sheets

METHOD AND APPARATUS FOR SECURING A SCAFFOLD TO A BUILDING

CROSS-REFERENCE TO RELATED APPLICATIONS

This application claims the benefit of U.S. Provisional Application No. 60/803,395, filed May 30, 2006, U.S. Provisional Application No. 60/804,421, filed Jun. 9, 2006 and U.S. Provisional Application No. 60/833,379, filed Jul. 26, 2006, and the entirety of these three applications are hereby incorporated by reference herein.

BACKGROUND OF THE INVENTIONS

1. Field of the Inventions

The present inventions relate generally to scaffolding and other bracing systems, and more specifically, to apparatuses, systems and methods for securely attaching scaffolding and other bracing systems to a building or other structure.

2. Description of the Related Art

Scaffolding assemblies are typically used during the construction, repair and/or maintenance of buildings and other structures. Once erected, a properly designed scaffolding system can be used by construction workers and others to safely access higher elevations of a targeted building or structure. However, in order to ensure the safety of workers and other personnel that utilize scaffolding systems, the connections between a building or other structure and a scaffolding system must be secure. Presently, in order to attach a scaffold to an adjacent structure, tie wires, welds and/or other types of connections are typically utilized.

SUMMARY OF THE INVENTIONS

An aspect of at least one of the embodiments disclosed herein includes the realization that some of the difficulties associated with the attachment and detachment of scaffolding to a building under construction can be avoided by providing a scaffolding attachment system that includes a portion that can be left within the building, partially embedded in the final finish layer of the outer surface of the building. For example, in some embodiments, such a scaffolding attachment system can include a flange member to be disposed at about the position of the final finish layer of the outer surface of the building. Additionally, a coupling can be mounted to the flange member. Thus, as the finish layer of the building is applied, the finish materials can be sealed to the flange member while leaving the coupling exposed. Thus, during this process, the coupling can be used for supporting the scaffolding at the desired position relative to the building under construction. After the final finish layer is substantially complete, the scaffolding can be disconnected from the coupling, and finish materials can be used to cover the coupling and thus leave the coupling and the flange embedded within the building.

Thus, in accordance with at least one of the embodiments disclosed herein, a scaffolding system can comprise a latticework of members defining at least one platform for supporting workers adjacent to a building under construction. A base member can be secured to a structural component of the building under construction. A coupling member can be secured to the base member, the coupling member having internal threads, the base member extending radially outwardly along a rear face of the coupling member forming a flange around the coupling member, the flange being disposed inwardly from and adjacent to the position of the final outer finish layer of the building under construction. The coupling member can have a longitudinal length, along the axial direction of the internal threads, that is less than the thickness of the final outer finish layer. A connecting member can have a first end and a second end, the first end having external threads configured to mate with the internal threads, the second end being attached to the latticework to thereby maintain the latticework in an upright orientation.

In accordance with at least one of the embodiments disclosed herein, an anchoring system for securing a scaffold to a building can comprise a connection member configured to attach to at least one scaffold component, the connection member having a first end. An anchor member can comprise a base configured to attach to at least one structural component of a building. A coupling can be fixedly connected to the base, the coupling can also be configured to receive the first end of the connection member to rigidly join the connection member to the anchor member.

In accordance with at least one of the embodiments disclosed herein, a method of securing a scaffold assembly to a building can comprise positioning a base of an anchor member relative to a structural component of a building under construction, the anchor member comprising the base and a coupling, the coupling being positioned at about a position of the final outer layer of the finish of the building. The method can also include attaching the base to the structural component of a building under construction, and securing a connection member to the coupling. Finally, the method can include securing the connection member to a scaffold assembly.

In accordance with at least one of the embodiments disclosed herein, a scaffold attachment device can comprise an anchor assembly comprising a base portion configured to be attachable to a structural component of a building under construction and a coupling portion configured to be attachable to and removable from a scaffolding support member. The base portion can comprise a flange portion extending radially from the coupling portion.

In some embodiments, the anchoring system includes a connection member configured to attach to a scaffold component and an anchor member. The anchor member includes a base configured to attach to at least one structural component of a building and a coupling fixedly connected to the base. The coupling is configured to receive a connection member to rigidly join the connection member to the anchor member, and thus, the scaffold to a building.

According to another aspect of at least one of the embodiments disclosed herein, the anchor system is configured to be permanently attached to the building. In other embodiments, however, the anchor system is configured to be temporarily attached to the building. In some embodiments, the anchor system is joined to an intermediate member, which is configured to attach to a portion of the building. According to one embodiment, the intermediate member includes a steel plate that comprises one or more openings adapted to receive an fastener.

In other embodiments, the base comprises an extension member, spacer portion or anchor support which is configured to provide a distance between the coupling and a location where the anchor member attaches to the building. According to some arrangements, the extension member includes a section of a circular pipe. In some embodiments, the anchoring system additionally comprises one or more barrier members. The barrier members, which partially surround the coupling, are configured to minimize or prevent the migration of substances towards the building in the vicinity of the anchoring system. In one embodiment, the barrier member comprises a substantially water-resistant film and/or sealant.

BRIEF DESCRIPTION OF THE DRAWINGS

These and other features, aspects and advantages of the inventions disclosed herein are described below with reference to the drawings of certain preferred embodiments, which are intended to illustrate and not to limit the inventions. The drawings comprise the following figures.

DETAILED DESCRIPTION OF THE PREFERRED EMBODIMENTS

The structural attachment and support system and the various methods and features associated with it are described in the context of a scaffold assembly and other bracing systems for buildings because they have particular utility in this context. However, the attachment and support devices, systems and methods described herein, as well as their various features, can be used in other contexts as well, such as, for example, but without limitation, for devices, systems and methods used in construction, structural reinforcement and the like.

The various embodiments of an anchoring system presented herein facilitate the assembly and/or disassembly of a scaffold system, as well as the finishing of the building subsequent to the removal of the exterior portions of the scaffolding system. As discussed, such procedures are aided by the use of relatively simple connections between scaffold connector members and adjacent anchor members which are attached to the building or other structure. In some embodiments where a threaded or similar type of connection is provided between the scaffold connector members and the anchor members, workers can easily attach the scaffold to the building, thereby eliminating time-consuming and labor-intensive connection methods, such as welding.

Further, the anchoring system provides a structurally secure method of attaching a scaffold to a building. This helps promote worker safety, eliminating workplace accidents that often occur when scaffolds are structurally undermined. In addition, such secure connections are better able to withstand the external forces and moments to which a scaffold assembly may be exposed. Some building codes and other regulations require that a scaffold assembly and its connections to an adjacent building or structure be designed to resist certain wind and earthquake loads, live loads exerted by workers and their equipment and the like.

As illustrated by the various embodiments discussed herein, the anchoring system can attach to different components of an adjacent building or structure. For example, the anchoring system can be configured to connect to a concrete wall or slab, a structural member (e.g., steel or other rigid plate, bar, angle, etc.), wood or other types of framing systems and/or the like. The anchoring system can be permanently or temporarily affixed to a building or other structure. In some embodiments, one or more sealing layers, members, other sealing features and the like, help ensure that water, other fluids and the like do not intrude into interior portions of a building.

Figure 1:
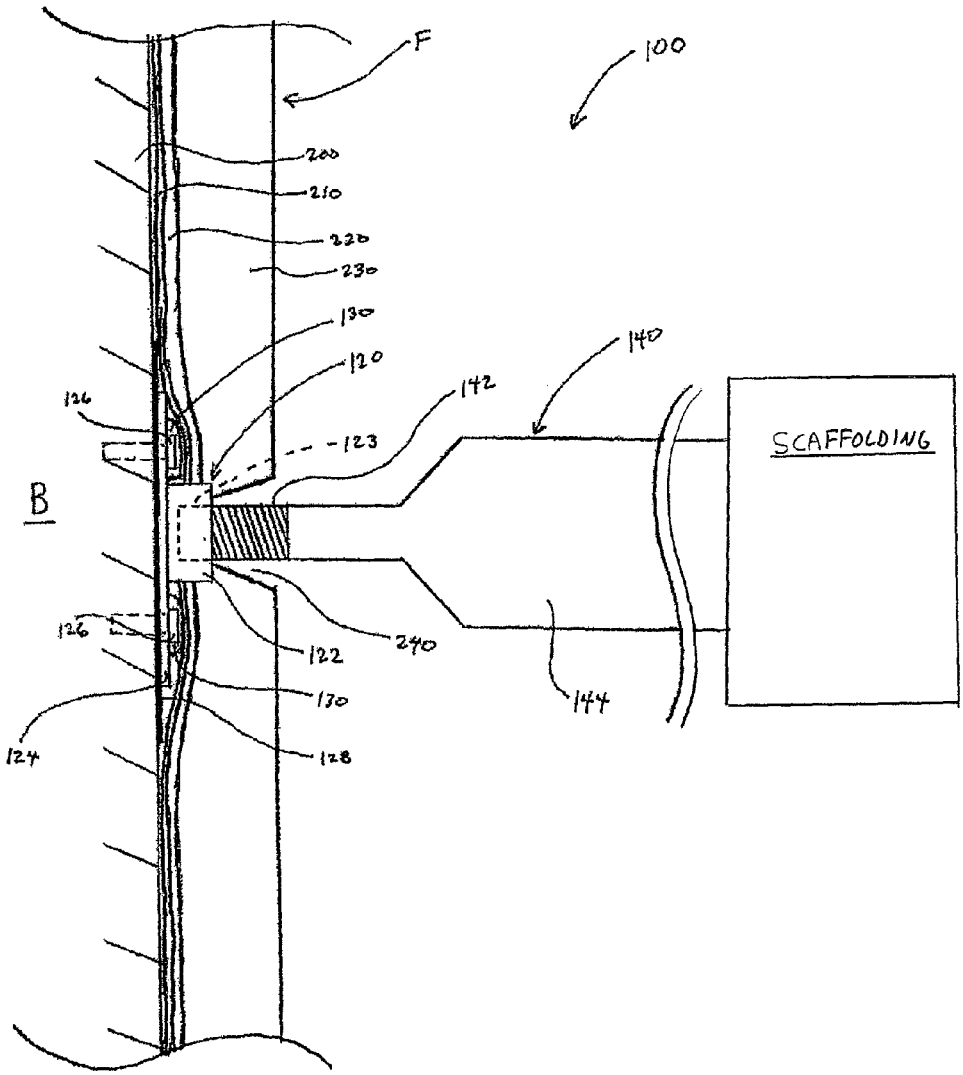
FIG. 1 illustrates a schematic and partial cross-sectional view of one embodiment of an anchoring system attached to a building surface and configured to receive a scaffold connection member.

FIG. 1 illustrates one embodiment of an anchoring system 100 which is configured to secure scaffolding or another peripheral structure to a building B. As well known in the art, the scaffolding normally will comprise a latticework of structural members, such as pipes, arranged in a way to form platforms upon which construction workers can stand during construction of the building B. However, the systems disclosed herein can be used with any type of scaffolding or other types of structures disposed adjacent to a building. The depicted anchoring system 100 can comprise an anchor member 120 that attaches to a building B or other structure at one or more locations.

In FIG. 1, a scaffold connector member 140, such as, for example, a scaffold pipe, strut, or other member, can be configured to be removably coupled to the anchor member 120. When coupled to an anchor member 120, the depicted connector member 140 extends outwardly, away from the building B and the anchor member 120. The connector member 140 can securely attach to or be integrated with an adjacent scaffold assembly or other peripheral structure.

In some embodiments, a plurality of anchoring systems 100 (e.g., anchor members 120 and corresponding connector members 140) are used to securely attach a scaffold to a building B. The exact details, such as, for example, the type, size, shape, dimensions, number, spacing, positioning and the like, related to the various components that comprise an anchoring system 100 can vary depending on the specific application.

With continued reference to FIG. 1, the anchor member 120 can include one or more couplings 122. In the depicted embodiment, the coupling 122 comprises an internal cavity portion which includes a plurality of threads. As shown, the internal (or female) threads are sized, shaped and otherwise configured to engage a male threaded portion 142 of the connector member 140. However, other types of connections can be used to attach an anchor member 120 to a scaffold connector member 140. For example, the anchor member 120 can alternatively include a male coupling having a plurality of external threads configured to engage a corresponding female threaded coupling positioned on the scaffold connector member 140.

Other embodiments comprise different types of mechanical and/or non-mechanical (e.g., magnetic couplings, electromagnetic couplings, etc.) connections. For example, the anchoring systems can comprise one or more bayonet mounts, ball and socket joint, hinges, lock rings, pin systems (e.g., cotter pin), swaging connections, tabbed connections, adhesive couplings or other types of mechanical connections. In other embodiments, adhesives and other types of bonding connections can be used.

In some embodiments, the coupling 120 is configured to generally restrict relative movement in any direction between the coupling 120 and the connector member 140. Thus, an anchoring system 100 can be configured to prevent movement of the scaffold assembly or other peripheral structure both towards and away from a building B.

With continued to FIG. 1, the anchor member 120 can comprises a base 124 to which the coupling 122 can be securely joined. The coupling 122 can be attached to the base 124 using welds, rivets, fasteners (e.g., bolts, nuts, etc.), adhesives and/or any other connection device or method.

In FIG. 1, the base 124 comprises a rigid steel plate. However, the base 124 can be manufactured from one or more other types of rigid materials. Further, the shape, size, thickness and other properties of the base 124 can vary.

In some embodiments, the coupling 122 comprises a threaded socket portion 123. To limit the extent to which a threaded item can be advanced within the coupling 122, the socket portion 123 terminates at a depth short of the base 124. Alternatively, even if the coupling 122 comprised an internal opening that extended along its entire length (e.g., a nut), the base 124 can be configured to effectively block such internal opening. In some embodiments, the coupling 122 comprises a ½-inch diameter hexagonal nut, and the base 124 comprises a 4 inch×32 inch plate constructed of 14-gauge galvanized steel. However, the size, shape, dimensions, materials of construction and other properties and features of the coupling 122 and the base 124 can vary.

The coupling 122 can be rigidly attached to the base 124 using welds, adhesive, fasteners and/or other connection device or methods. In some embodiments, the coupling 122 and base 124 comprise a unitary member.

The base 124 can be securely attached to a building B using one or more attachment devices or methods, such as, for example, fasteners (e.g., anchor bolts, other bolts, screws, rivets, clips, nails, tabs, pins, etc.), other mechanical couplings, welds, adhesives, etc. In the illustrated embodiment, the base 124 is attached to the building underwall 200 (e.g., sheathing, plywood, drywall, etc.) using a plurality of bolts 126. Regardless of the exact connection method or methods used, the base 124 is preferably rigidly attached to one or more structural components of the building B. For example, the anchor member 120 can be rigidly joined to a concrete slab, one or more framing studs, structural steel members or the like. As used herein, any portion of the building can be considered to be a "structural" portion or component of the building if it has sufficient strength to contribute to supporting scaffolding in a position adjacent to a building under construction. A single sheet ½ inch sheet of sheet rock or a span of unsupported stucco would not be considered as a "structural" portion of a building.

With continued reference to FIG. 1, a seal layer 128 can be applied between the base 124 and the adjacent surface of the building B. As a result, any bolts, nails, screws or other fasteners used to rigidly connect the base 124 to the building B penetrate the seal layer 128. Thus, the presence of the seal layer 128 acts to prevent or minimize the instruction of moisture through the openings created by such fasteners. In some embodiments, the seal layer 128 comprises butyl rubber (e.g., tape, film, gel, etc.), resilient sealing rubber and/or other sealing materials. Additional protection against moisture intrusion can be achieved by applying a sealing caulk 130 on bolt heads or other openings through which moisture can pass.

In the illustrated embodiment, the base 124 of the anchor member 120 abuts an underwall 200 of the building B. As shown, a seal member 128 is positioned between the anchor member 120 and the underwall 200. Depending on the particular building design, the underwall 200 can include a first barrier layer positioned over an underlying structural layer of sheathing, drywall, plywood or the like. In some embodiments, the barrier layer comprises a water or moisture-resistant film or paper, such as, for example, building paper, tar paper, polyethylene fibril film (e.g., TYVEK®, DuPont) or the like.

In some embodiments, additional barrier layers or other types of films or substances can be provided. For example, in FIG. 1, a second barrier layer 210 is provided to cover the building underwall 200 and a portion of the anchor member 120. The second barrier layer 210 can have similar water-resistant properties as the first barrier layer used on the building underwall 200. Such additional barrier layers can further protect against the undesirable intrusion of water or moisture into interior portions of a building B.

Optionally, however, the second barrier layer 210 can be different (e.g., with respect to type, size, thickness, purpose, etc.) from the first layer used on the underwall 200. In the illustrated embodiment, the second barrier layer 210 covers a portion of the anchor member 120. The second barrier layer 210 can include one or more openings to provide exterior access to the coupling 122.

The barrier layers used in a particular embodiment can be bonded to adjacent surfaces (e.g., sheathing, drywall, subfinish, etc.) and/or to each other using appropriately applied adhesives. This can further reinforce the integrity of a building's exterior and/or better protect against undesirable water or moisture intrusion. As discussed herein with respect to other embodiments, one or more other films, layers, coatings, sealants, caulking, water management systems or the like can used to provide a better moisture and water barrier.

With continued reference to the embodiment of FIG. 1, a building finish F is disposed over the underwall 200 and the second barrier layer 210. The finish F can comprise a sub-finish layer 220 and an outer finish layer 230.

An opening 240 can be formed in the outer finish layer 230 to provide access to the coupling 122 from the exterior of the building. Therefore, such an opening 240 can permit a user to locate a coupling 122 and engage it with a scaffold connecting member 140. In some embodiments, the sub-finish 220 comprises a lathing layer and the outer finish 230 comprises plaster. Alternatively, the sub-finish 220 can include more or fewer layers. In addition, the layers can vary with respect to the material types, order, thicknesses and the like. Additional coats or materials, such as scratch coats, brown coats, finish coats, seal coats, lath, reinforcement and/or the like can also be included.

As shown in FIG. 1, the connector member 140 can comprise a male threaded end portion 142 which is configured to removably engage female threaded coupling 122. In the illustrated embodiment, the threaded end portion 142 of the connector member 140 is approximately 4-inch long. In addition, the diameter of the threaded end portion 142 can be ⅛-inch or smaller, ½-inch, ⅝-inch, ¾-inch, 1-inch or greater, or any other dimension. The diameter can also be a non-standard size to accommodate a particular application. In other embodiments, the length and/or the diameter of the threaded end portion 142 can be greater or smaller than indicated herein. As discussed, another type of connection between the anchor member 120 and the connecting member 140 can be provided, such as, for example bayonet mounts, ball and socket joint, hinges, lock rings, pin systems (e.g., cotter pin), swaging connections, tabbed connections, adhesive couplings or other types of mechanical connections.

Alternatively, the connector member 140 can include an end portion 142 with female (internal) threads. In such embodiments, the anchor member 120 includes a male coupling 122 having external threads to properly engage a connector member 140. In other embodiments, the connector member 140 can connect to the anchor member 120 using one or more other devices or methods. For example, the connector member 140 and the anchor member 120 can include corresponding magnet/electromagnet components, adhesives, specially-designed couplings or joints or the like.

As illustrated in FIG. 1, the threaded end portion 142 of the connector 140 can be joined to or formed as unitary member with a shaft portion 144. In some embodiments, the shaft portion 144 is part of a scaffold pipe or other support member used in the assembly of the scaffold system. Alternatively, the shaft portion 144 can be a separate member that is adapted to rigidly connect to one or more portions of a scaffolding assembly. In some embodiments, the shaft portion 144 comprises a 30-inch long, 1-⅝-inch diameter scaffold pipe. However, depending on the particular design parameters, the shaft portion 144 can be longer or shorter than 30 inches. In addition, the diameter of the shaft portion 144 can be larger or smaller than 1⅝ inches. Further, the shape, dimensions and general configuration of the connector member 140 and/or the shaft portion 144 can be different than illustrated and discussed herein. For instance, the shaft portion 144 can have a generally rectangular, oval, triangular or other type of regular or irregular cross-sectional shape.

In use, after the required anchor members 120 have been properly attached to the building or other structure, assembly of the scaffold can commence. Consequently, workers can attach the connector members 140 to the corresponding anchor members 120 as the scaffold is being constructed. For additional assurance that the connections (e.g., threaded, other mechanical, etc.) that join the scaffold assembly to the building will not be jeopardized, one or more adhesives, films (e.g., PTFE tape), bonding agents or other materials can be applied to the anchor member 120 and/or the connector member 140.

During the disassembly of a scaffold or other peripheral structure, the connector members 140 can be readily removed from the corresponding anchor members 120 (e.g., undoing the threadable advancement, releasing a mechanical coupling, etc). However, as a result of removing a connector member 140 from an anchor member 120, the opening 240 within the building finish F becomes fully exposed.

Figure 2:
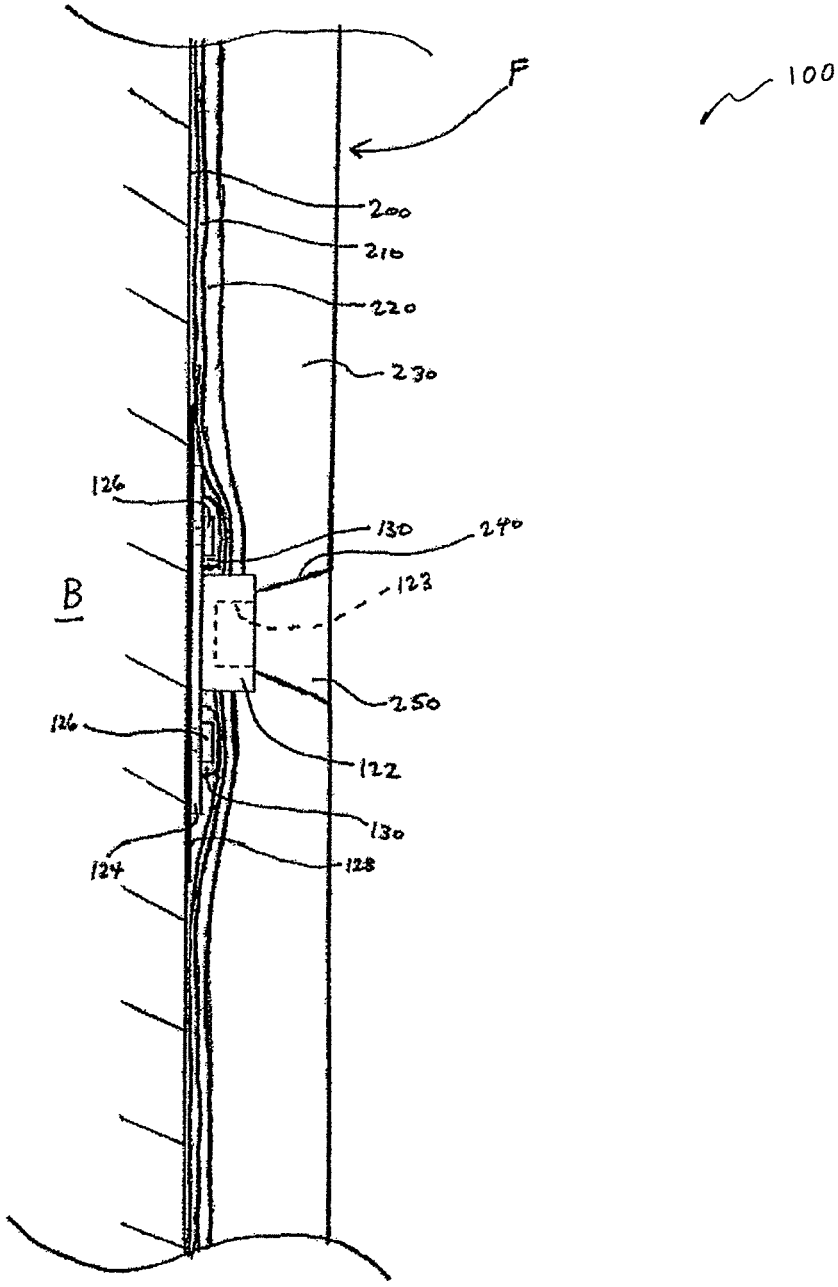
FIG. 2 illustrates the anchoring system of FIG. 1 with the scaffold connection member detached.

With reference to FIG. 2, a finishing cap 250 can be used to fill the opening 240 in the outer finish 230. This can enhance the aesthetics of the building exterior and further prevent moisture intrusion. In some embodiments, a coating is applied to the exposed surfaces within the opening 240 to enhance the binding of the finishing cap 250. The cap 250 can consist of the same type of material as the outer finish 230. For example, the opening 240 can be filled or covered with plaster, grout, concrete or any other material to match the outer finish 230. However, in other embodiments, the cap 250 comprises a different material than the surrounding outer finish 230. In addition to or in lieu of a cap 250, one or more additional outer layers, such as, for example, stone sheets, marble, siding, sheathing, metal and the like, (not shown) can be installed to the outside of the outer finish 230.

Figure 3:
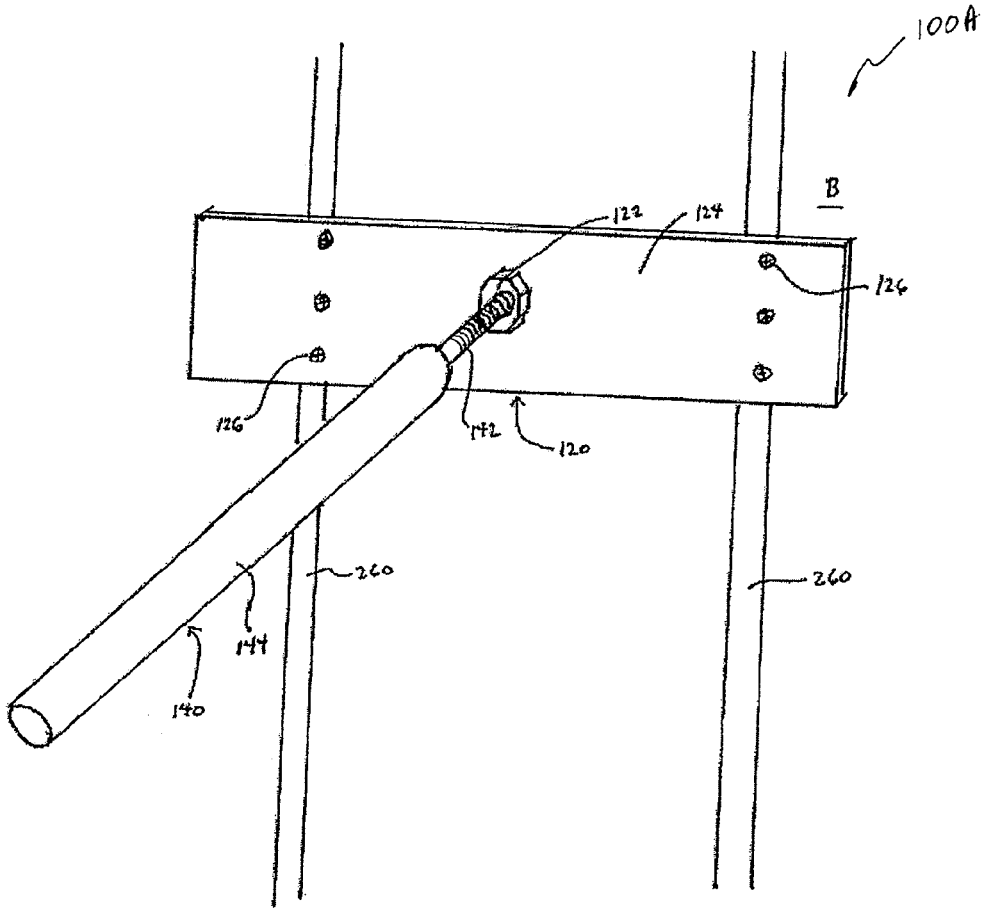
FIG. 3 illustrates a perspective view of another embodiment of an anchoring system configured to attach to framing members.

FIG. 3 illustrates a modification of a scaffold anchoring system 100 which is referred to generally by the reference numeral 100A. The anchoring system 100A can include the same or similar components as the anchoring system 100 except as noted below. Some of the components of the anchoring system 100A that can be similar or the same as the corresponding components of the anchoring system 100 are identified with the same reference numerals and some are identified with unique reference numerals.

For clarity, portions of the building B have been removed from FIG. 3. As shown, the anchor member 120 can be fixedly attached to two or more framing members 260 (e.g., vertical studs). In the illustrated embodiment, the base 124 comprises a rectangular steel plate 124 which is connected to the framing members 260 using a plurality of screws 126. Alternatively, the base 124 can be attached to the framing members 260 using one or more other connection devices or methods (e.g., bolts, other fasteners, adhesives, etc.). As in the embodiments discussed above with reference to FIGS. 1 and 2, the depicted anchoring system 100A includes an anchor member 120 which is configured to receive a threaded end portion 142 of a connector member 140.

FIGS. 4A-4F illustrate, in time sequential order, one embodiment of steps of a method for securing a scaffold or other peripheral structure to a building B by utilizing an anchoring system 100. In the depicted embodiment, the framing members 260 (e.g., structural studs) of the building B extend from a floor structure F to a ceiling structure C.

Figure 4A:
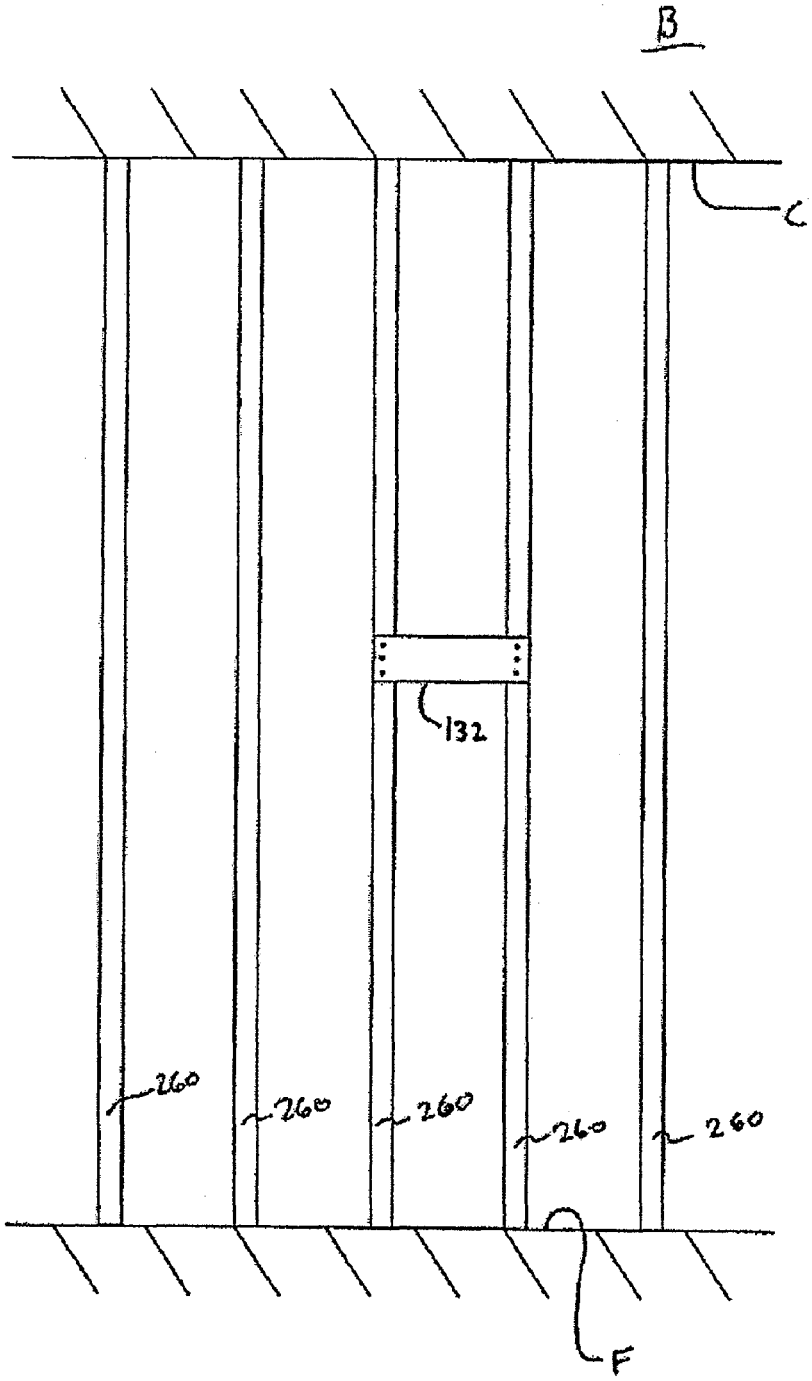
FIGS. 4A-4F illustrate time sequential steps of installing an anchoring system to framing members of a structure in accordance with one embodiment.

With reference to FIG. 4A, an optional backing member 132 can be affixed to one or more of the framing members 260 in the approximate location where the anchor member 120 will eventually be installed. This can be advantageously accomplished while the building is still being constructed as the framing members 260 are generally easily accessible. In some embodiments, the optional backing member 132 can comprise a 14-gage galvanized steel plate. However, other sizes and materials can also be used.

Figure 4B:
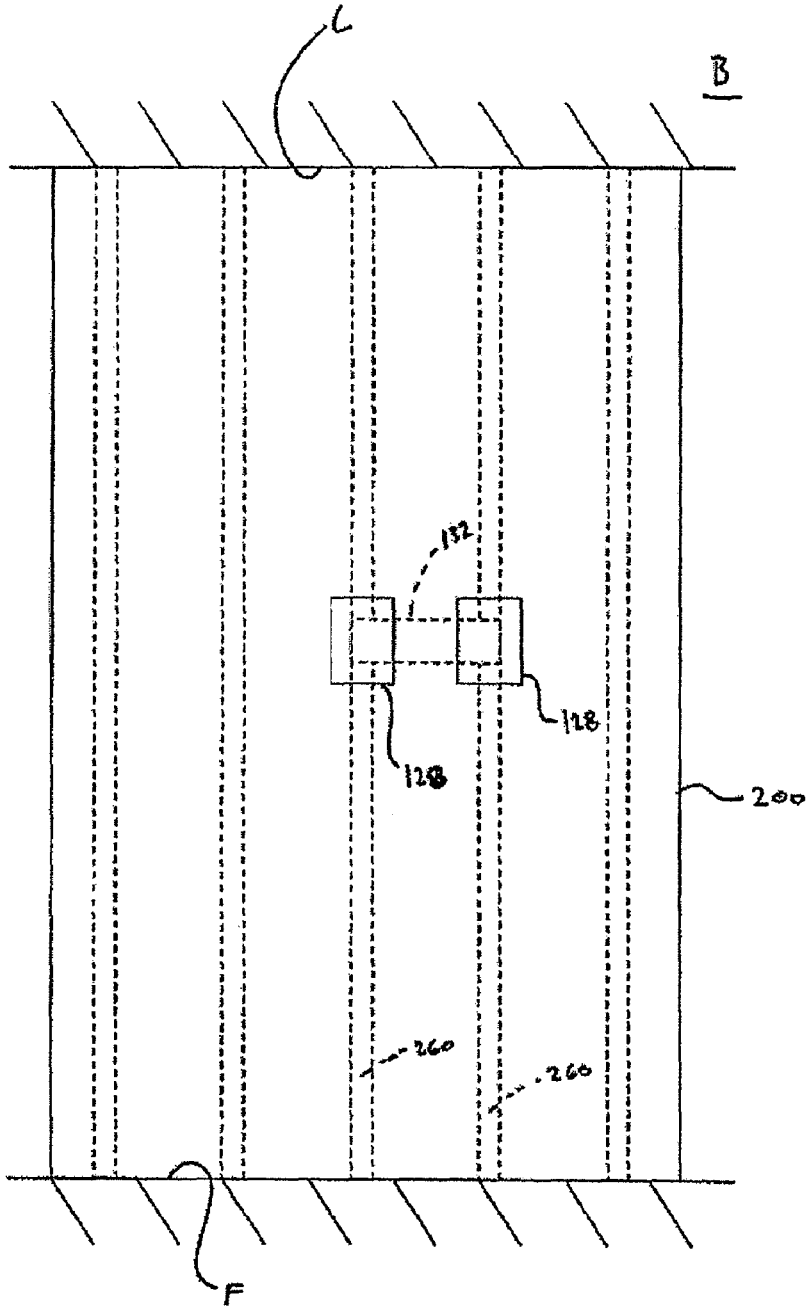

Next, as shown in FIG. 4B, an underwall 200 (e.g. sheathing with building paper, drywall, etc.) can be applied over the framing members 260 and/or the backing member 132. In addition, as discussed above, a seal layer 128 can be applied over the underwall 200 to cover the anticipated location of bolts, screws, rivets or any other fasteners that may penetrate the underwall surface.

Figure 4C:
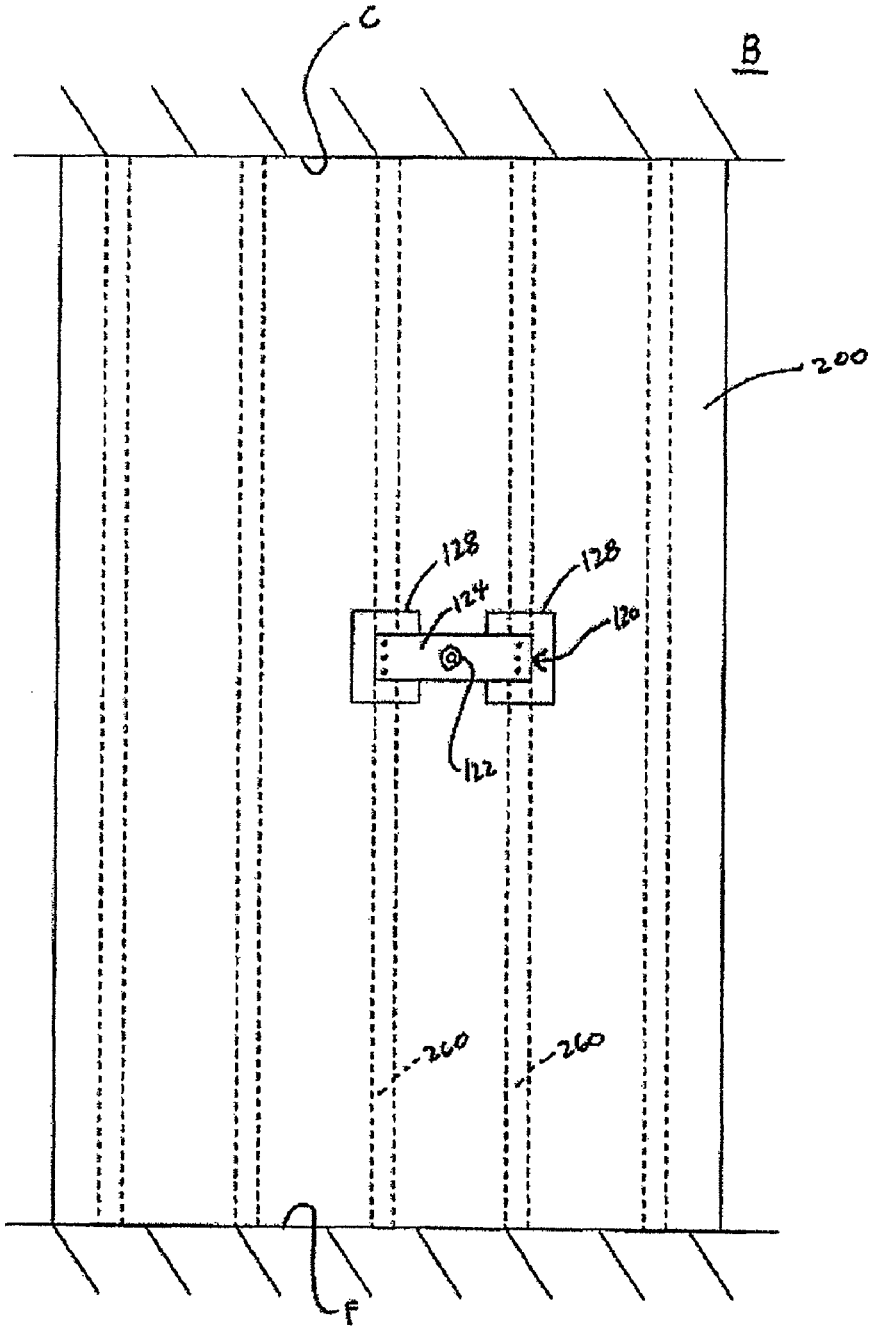

With reference to FIG. 4C, the anchor member 120 can then be secured to the framing members 260 using a plurality of fasteners that penetrate both the seal layer 128 and underwall 200. Once the anchor member 120 is so installed, the coupling 122 can then be connected to scaffolding. Such scaffolding can be used by workers in completing the finishing of the exterior of the building. Optionally, at any step where additional layers of finishing materials are placed around the coupling 122, the associated connector member 140 (FIG. 1) can be removed to allow a whole piece of barrier or other layering material over or around the coupling 122. During such a procedure, adjacent connector member 140 can provide sufficient restraining force to maintain the scaffolding in the proper orientation. After such a layer is added, the connector member 140 can be reconnected to the coupling 122.

Figure 4D:
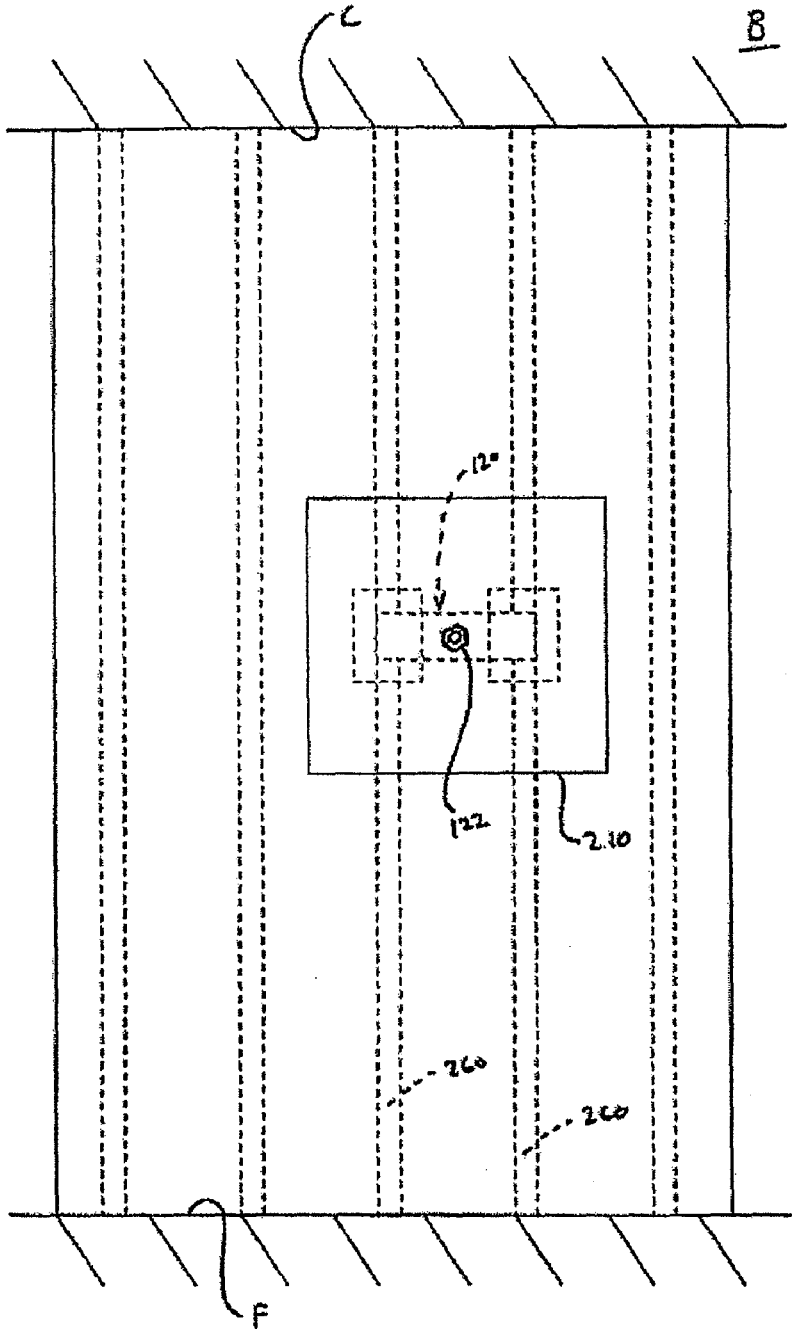
Figure 4E:
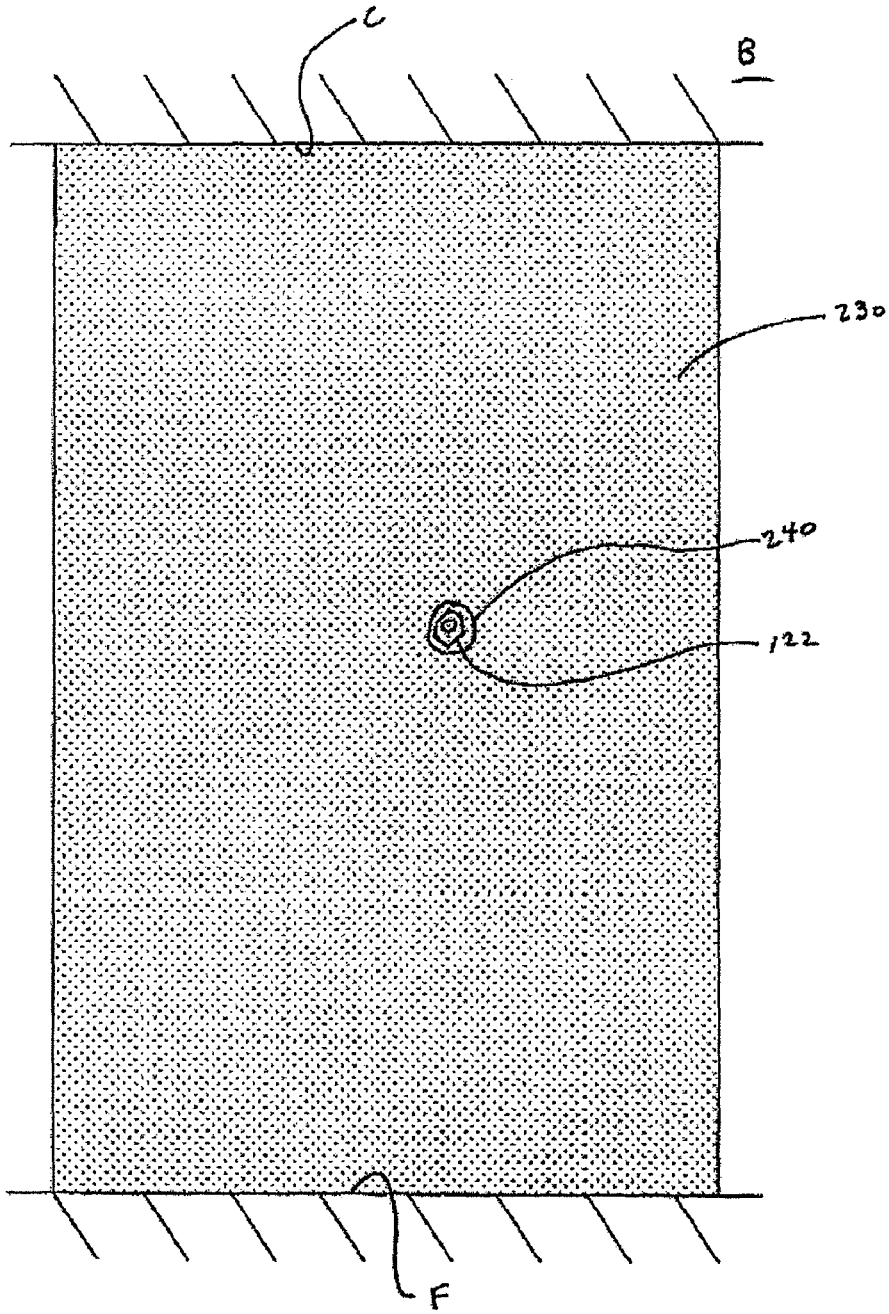

In FIG. 4D, a second barrier layer 210 (e.g., water resistant layer) is placed over the anchor member 120. An opening can be formed in such a barrier layer 210 to provide access to the coupling 122. In some embodiments, such an opening is closely formed around the exterior of the coupling 122 to minimize the possibility of moisture intrusion. Additionally, the coupling can be sized so as to extend from the base 120 and through the opening in the barrier layer 210.

As shown in FIG. 4D, an initial layer of the outer finish 230 can be placed on the underwall 200 and second barrier layer 210. An opening 240 provided in the outer finish 230 permits the coupling 122 to extend toward the exterior surface of the building B. In some embodiments, the coupling 122 is sufficiently long so as to extend through the opening 240. As discussed, a connection member (not shown) can be subsequently attached to the coupling 122 to structurally secure a scaffold assembly to the building B.

At any point after the installation of the anchor member 120 to the building B, a scaffold assembly or other peripheral structure may be secured to the building B by engaging the connector member 140 to the coupling 122. As discussed, multiple connector members 140 are typically used to attach a scaffold to a building B. As work proceeds on the building exterior, one or more of the installed connector members 140 can be temporarily or permanently disengaged from the corresponding anchor member 120 to provide improved access to a desired location near the building exterior or for any other reason. If needed, such connector members 140 can be easily and quickly re-attached to the corresponding anchor members 120.

Figure 4F:
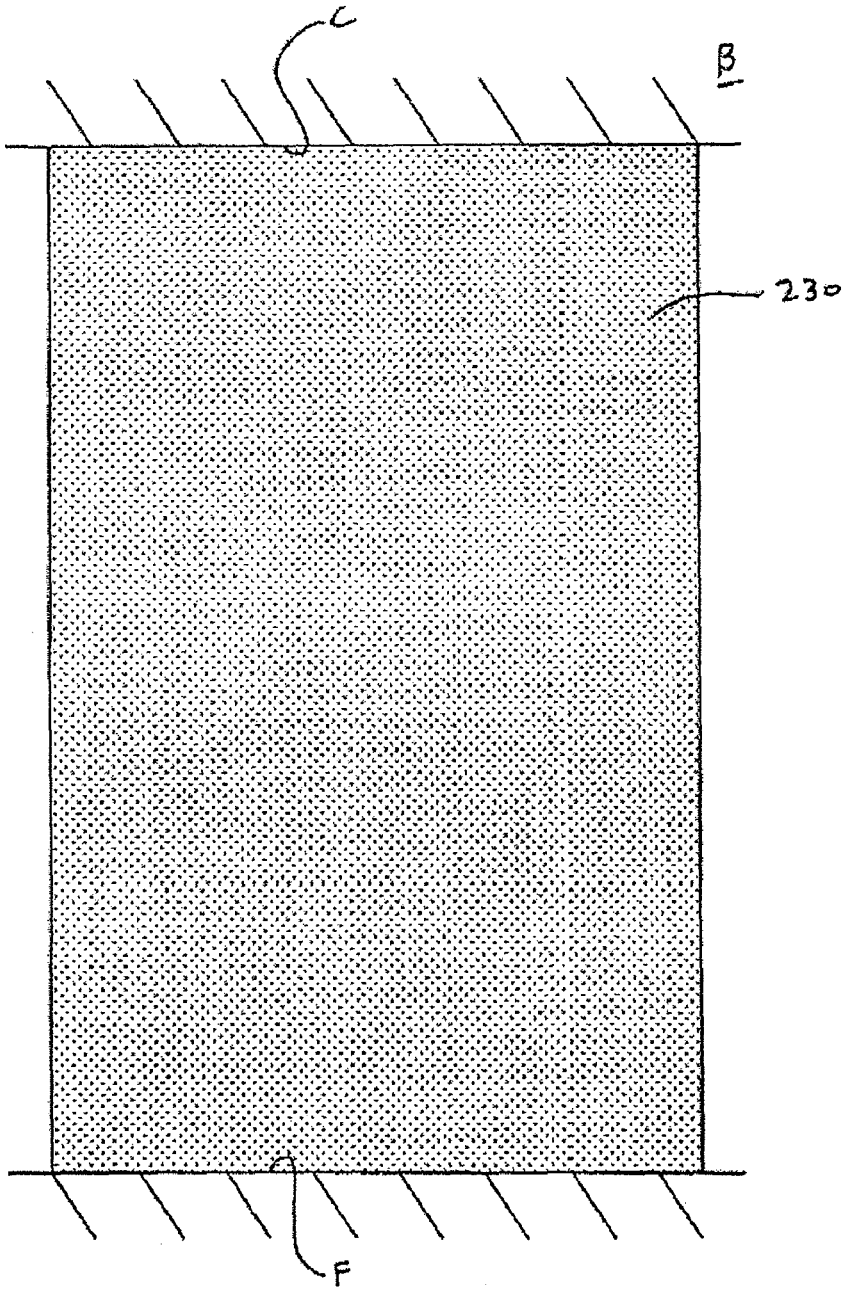

Once a scaffold assembly or other peripheral structure is no longer needed, the connector members 140 can be disengaged and removed from the corresponding anchor members 120. In addition, as discussed above with reference to FIG. 2, a cap 250 (e.g., plaster, grout, etc.) can be placed within the opening 240 adjacent to the coupling 122. This results in a complete and substantially continuous outer finish 230 as illustrated in FIG. 4F. Should it become necessary to re-install the scaffold assembly or other peripheral structure in the future, the cap 250 can be removed to permit a connector member 140 to re-engage the coupling 122 of anchor member 120.

In some embodiments of the methods of use the systems 100, 100A described above, and the other systems described below, the final finishing, including the filling of the openings 240 noted above, can follow a top-down sequence. For example, but without limitation, after the entire exterior of the associated building B has been completed, with the exception of the openings 240, finishers can remove the uppermost connector members 140 and then fill all of the upper-most openings 240 on the building B. Then the uppermost level of scaffolding can be removed and the next lower row of connector members 140 can be removed. The openings associated with this next lower row of connectors 140 can then be filled. This process can repeat until all of the openings 240 have been filled and all of the scaffolding has been removed.

Figure 5:
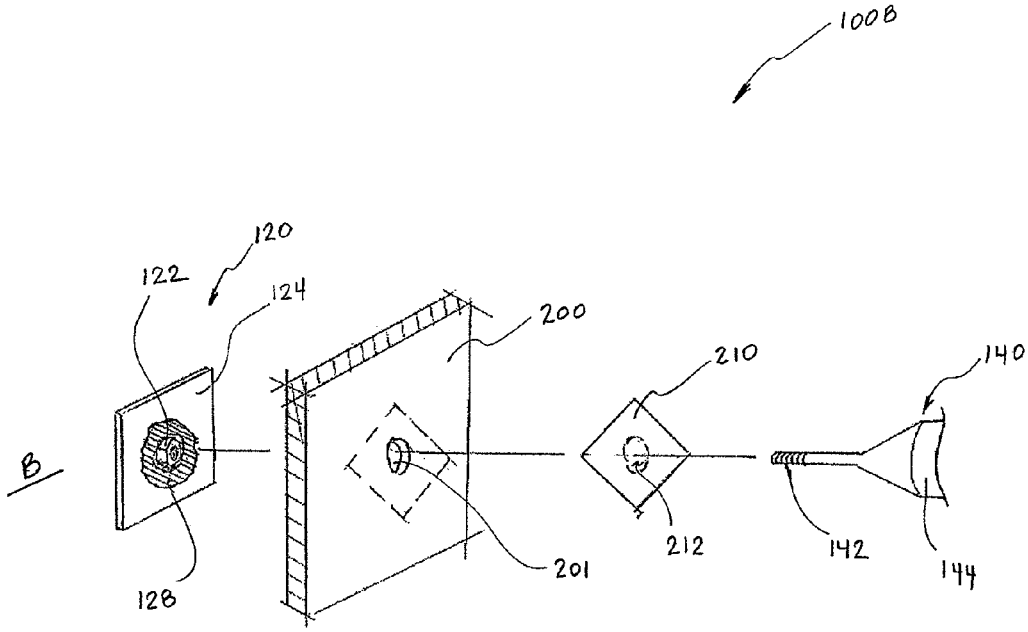
FIG. 5 illustrates a perspective view of the various components and layers of a scaffold anchoring system according to one embodiment.

FIG. 5 illustrates another modification of a scaffold anchoring system 100 which is referred to generally by the reference numeral 100B. The anchoring system 100B can include the same or similar components as the anchoring systems 100, 100A except as noted below. Some of the components of the anchoring system 100B that can be similar or the same as the corresponding components of the anchoring systems 100, 100A are identified with the same reference numerals and some are identified with unique reference numerals. As depicted, the anchoring system 100B comprises an anchor member 120, which includes a coupling fixedly attached to a base 124.

A first seal layer 128 can be applied around the periphery of the coupling 122. In some embodiments, the seal layer 128 comprises a film (e.g., butyl rubber tape, resilient sealing rubber sheet, etc.) or a paste (e.g., resilient caulking material). An opening 201 in the underwall 200 can advantageously provide access to the coupling 122 after the underwall 200 has been positioned immediately adjacent to the anchor member 120.

As discussed, a second barrier layer 210 can be attached to the exterior of the underwall 200 to provide additional protection against moisture intrusion within the interior of the building B. A relatively small opening 212 in the second barrier layer 210 provides the necessary access to permit a connection member 140 to adequately engage the coupling 122 of the anchor member 120.

Figure 6A:
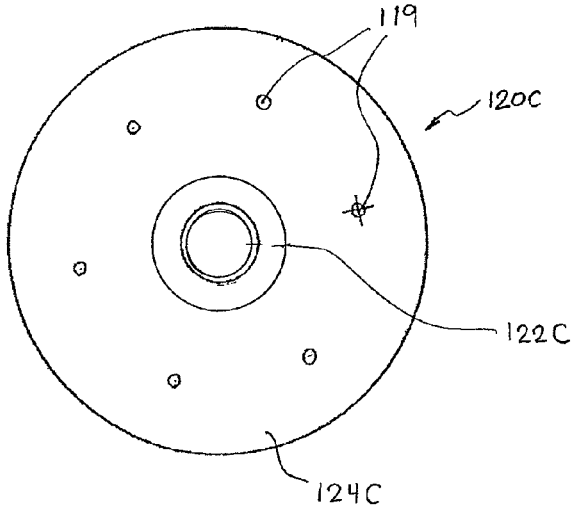
FIG. 6A illustrates a front elevational view of one embodiment of a circular anchor member.
Figure 6B:
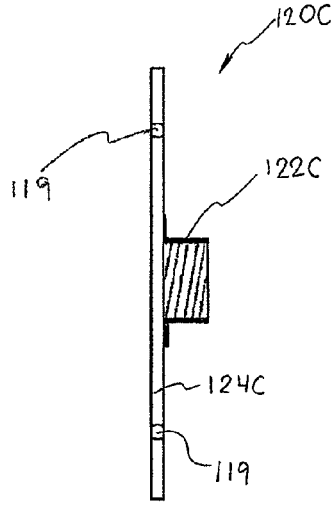
FIG. 6B illustrates a side elevational view of the circular anchor member of FIG. 6A.
Figure 7:
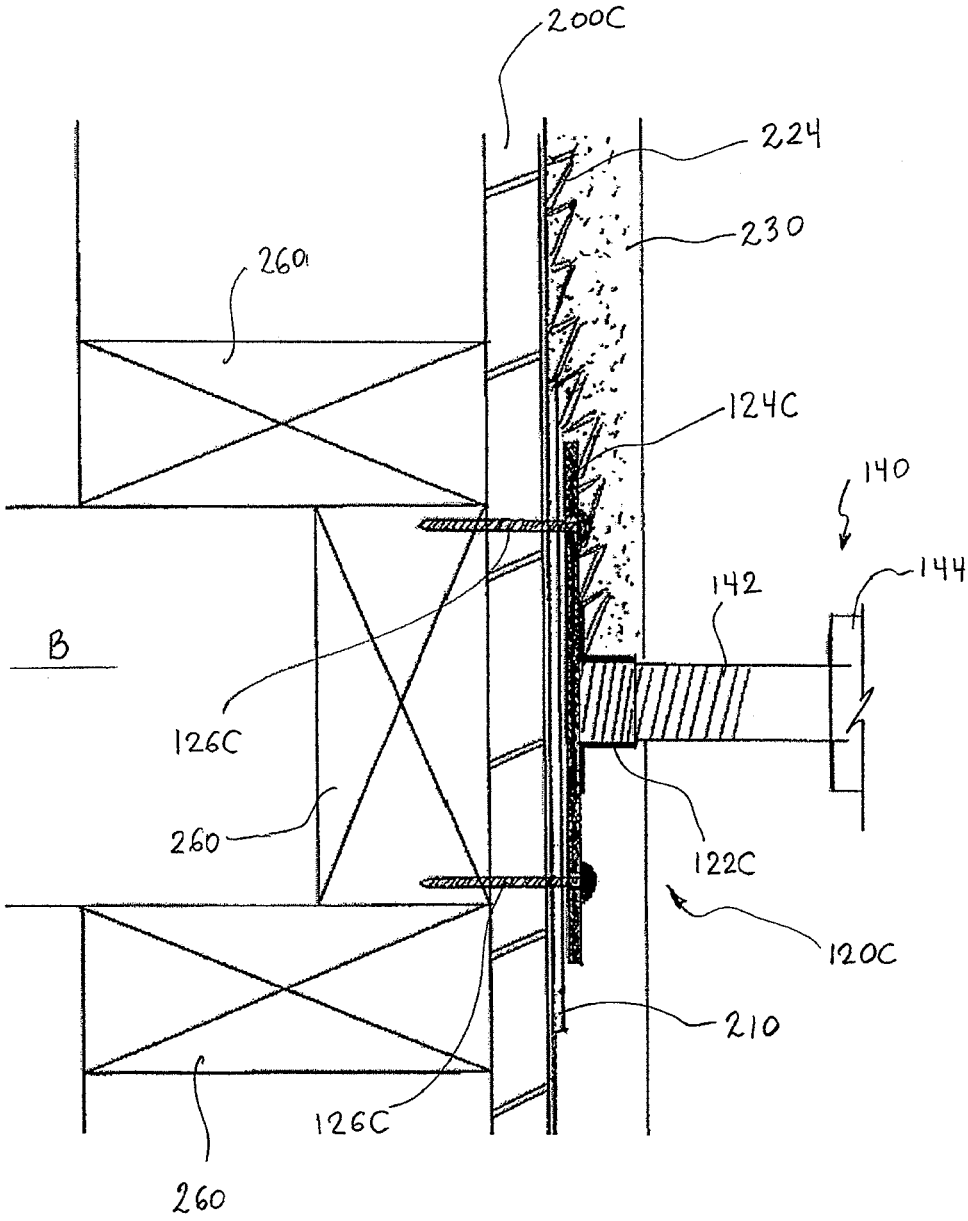
FIG. 7 illustrates a schematic and partial cross-sectional view of one embodiment of a scaffold anchoring system for connection to wood framing, utilizing the anchor members of FIGS. 6A and 6B.

FIGS. 6A, 6B and 7 illustrate another embodiment of an anchor member 120C having a generally circular outer shape. With reference to FIG. 6A, the anchor member 120C can comprise a coupling 122C and a circular base 124C. The coupling 122C and the base 124C can be joined using welds, adhesives, fasteners or any other attachment method.

As with the embodiments disclosed above, the coupling 122C can include an interior threaded portion which is sized and otherwise configured to receive a connection member (e.g., connection member 140) for a scaffold (not shown). In the illustrated embodiment, the base 124C can include a plurality of openings 119 which are sized and configured to receive screws, bolts and/or other fasteners.

In some embodiments, the base (FIGS. 6A and 6B) can be constructed of 10 gauge sheet metal and has an outer diameter of approximately 4¾ inches. In addition, the coupling 122C can define an opening having an interior diameter of approximately ¾-inch. Further, the base 124C can include six equally-spaced 5⁄32-inch diameter openings 119 that are located about ¾-inch from the periphery of the base 124C. However, in other embodiments, the dimensions, shape, materials of construction, opening details (e.g., shape, diameter, spacing, size, location, etc.) and other properties related to the anchor member 120C can vary.

The anchor member 120C illustrated in FIGS. 6A and 6B is particularly well-suited for attachment to wood framing. With reference to FIG. 7, the anchor member 120C is attached to one or more wood framing members 260 of a building B. The framing members can include, for example, but without limitation, studs, blocking, or other members.

In the depicted embodiment, the anchor member 120C is situated adjacent to a portion of underwall 200C (e.g., drywall, plywood, etc.). Anchoring screws 126C placed through the openings 119 of the base 124C can be advanced through the underwall 200C to engage a wood framing member 260. As shown, for additional protection against moisture intrusion, a barrier layer 210 can be positioned between the base 124C and the underwall 200C.

With continued reference to FIG. 7, lath sheeting 224 or any other layer, coating or material can be placed on the outside of the underwall 200C and anchor member 120C. In the illustrated embodiment, an outer finish layer 230 is formed which extends beyond the outer edge of the coupling 122C. Thus, as discussed, an opening can be provided in such finish layer 230 to provide access to the coupling 122C from the exterior of the building B. As shown, a threaded end portion 142 of a connecting member 140 is configured to threadably engage the interior of the coupling 122C. After disengagement of the connecting member 140 from the anchor member 120C, the opening in the finish layer 230 can be filled or otherwise closed as described above.

Other embodiments can comprise different types of mechanical and/or non-mechanical (e.g., magnetic couplings, electromagnetic couplings, etc.) connections between the connecting member 140 and the anchor member 120. For example, the anchoring systems described herein can comprise one or more bayonet mounts, ball and socket joint, hinges, lock rings, pin systems (e.g., cotter pin), swaging connections, tabbed connections, adhesive couplings or other types of mechanical connections. Other types of bonding connections can also be used.

Figure 8:
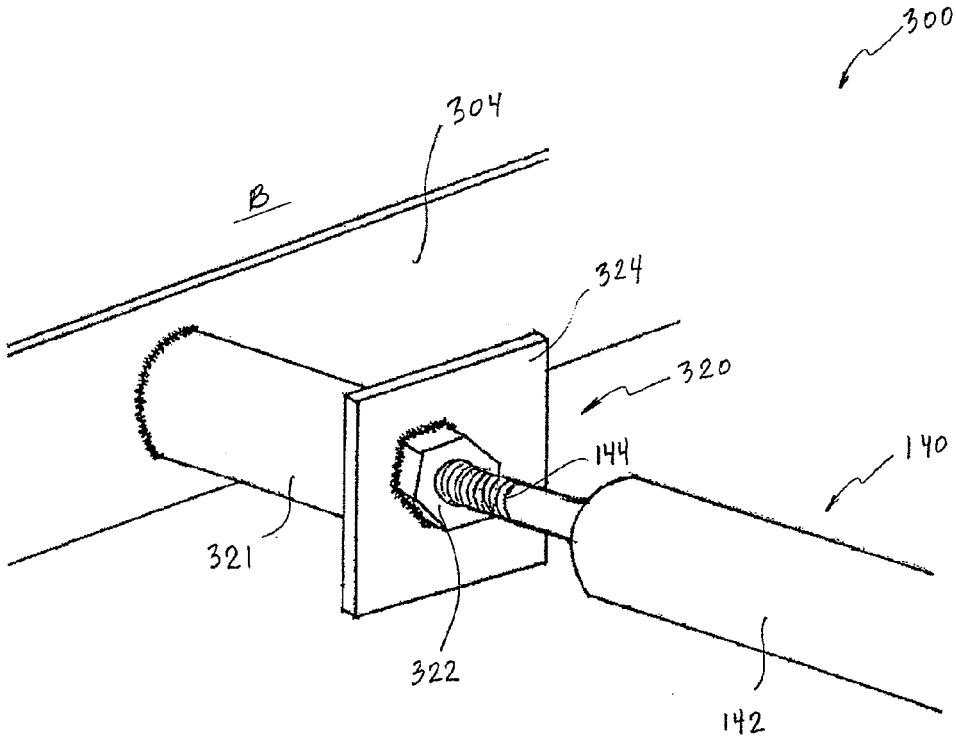
FIG. 8 illustrates a perspective view of one embodiment of a scaffold anchoring system attached to a rigid plate.
Figure 9:
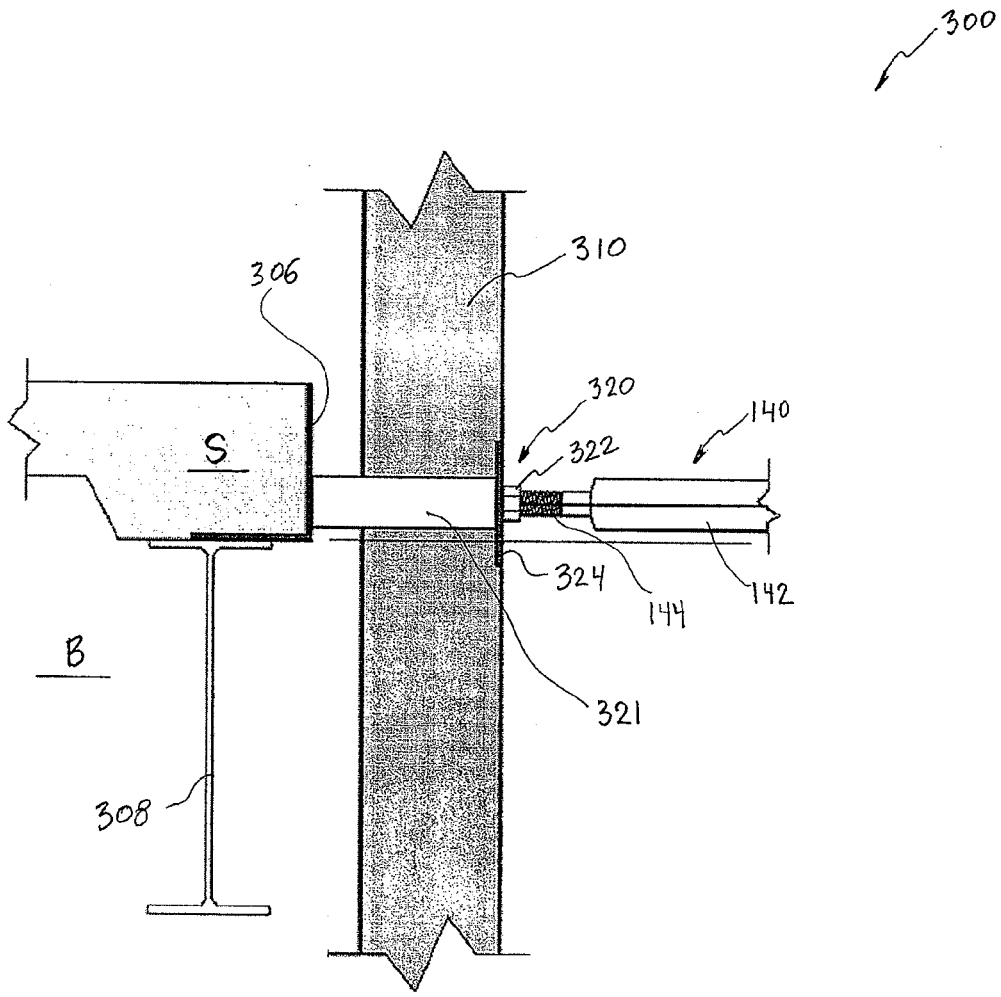
FIG. 9 illustrates a schematic and partial cross-sectional view of the scaffold anchoring system of FIG. 8 attached to a bent plate.

FIGS. 8 and 9 illustrate another modification of the scaffold anchoring system 100 which is referred to generally by the reference numeral 300. The anchoring system 300 can include the same or similar components as the anchoring systems 100, 100A, 100B except as noted below. Some of the components of the anchoring system 300 that can be similar or the same as the corresponding components of the anchoring systems 100, 100A, 100B are identified with the same reference numerals and some are identified with unique reference numerals.

With reference to FIG. 8, the anchor member 320 includes an anchor support 321 which, in the illustrated embodiment, extends from the base 322 to a structural component or other highly stable portion of the building B. In some embodiments, the anchor support 321 (e.g., spacer portion, extension member, etc.) can be attached to a floor and/or ceiling slab of the building (e.g., to the side or edge of a slab). In the arrangement shown in FIG. 8, the anchor support 321 is attached to a steel plate 304 (e.g., bent plate).

An anchor support 321 can be used to effectively move the base 324 and coupling 322 of the anchor member 320 further away from the building B. The anchor support 321 can be attached to the base 324 and/or a building surface (e.g., steel plate 304) using welds, fasteners, adhesives and/or any other connection device or method. For example, in some embodiments, ¼-inch radius welds are used to connect the ends of the anchor support 321 to the base 124 and steel plate 304.

Use of an anchor support 321, as illustrated in FIGS. 8 and 9, to connect an anchor member 320 to a highly stable portion of the building B (e.g., side of the floor or ceiling slab) can be particularly desirable for exterior scaffolds. If properly designed, the structural integrity of such anchor members 320 can result in a scaffold assembly that is capable of withstanding high external loads and moments (e.g., wind load, seismic loads, etc.). Presently, many state building codes (e.g., California Building Code, etc.) require exterior scaffolds to withstand certain external forces and moments. For example, in California, scaffold assemblies must be capable of adequately resisting wind loads resulting from 70 mile per hour winds. Consequently, the rigid connections between the scaffold assembly and the building B, through the use of scaffold anchoring systems as described herein, can permit scaffold system to accommodate additional weight and loads (e.g., tarps attached to the exterior of the scaffold, workers and/or equipment weight, etc.).

In the embodiment of the anchor member 320 illustrated in FIG. 8, the anchor support 321 comprises a 10-inch long section of pipe having an approximate outer diameter of 1⅝ inches and an approximate wall thickness of ⅛ inches. Further, in such an embodiment, the base 324 of the anchor member 320 comprises a 4-inch square steel plate having a thickness of approximately ¼ inches. However, this is merely one example of an anchor member 320. Therefore, the anchor support 321 and base 324 can have a different shape, size, dimensions, method of attachment to adjacent surfaces, general configuration and/or other properties.

In the embodiment of FIG. 9, additional details and optional features related to the illustrated scaffolding anchoring system 300 are provided. In the depicted arrangement, the anchoring system 300 includes an anchor member 320 which is fixedly attached to the building B via an anchor support 321. One end of the anchor support 321 can be connected to the outer face of a steel bent plate 306, which extends along the edge of the floor or ceiling slab S. Further, the other end of the anchor support 321 can be rigidly joined to the base 324 of the anchor member 320. As shown, the slab S can be supported by a structural steel member (e.g., I-beam 308).

With continued reference to FIG. 9, the length of the anchor support 321 can be selected so that the outer face of the base 324 is substantially flush with the outer edges of the building's exterior studs 310. Thus, the anchor member 320 can be installed in the space provided between adjacent exterior studs 320.

Figure 10:
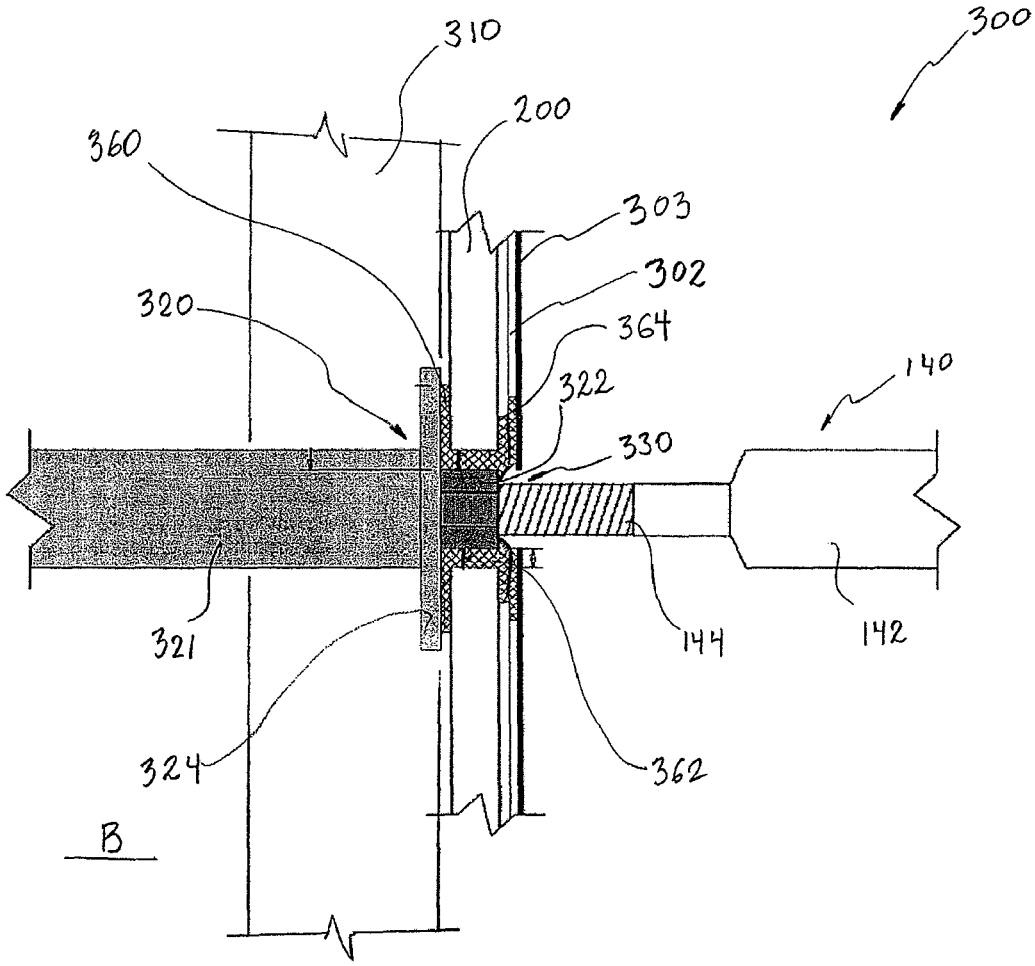
FIG. 10 illustrates a schematic and partial cross-sectional view of an embodiment of a scaffold anchoring system with the building's underwall and other layers attached.

As illustrated in FIG. 10, an underwall 200 (e.g., exterior sheathing, siding, etc.) can be installed over the exterior studs 310 and the base 124 of the anchor member 320. The underwall 200 can advantageously include an opening through which the coupling 322 can pass. In the illustrated embodiment, the outer surface of the base 324 and the outer surfaces of the studs 310 are sufficiently flush, thereby creating a substantially smooth surface on which the underwall 200 can be positioned. In some preferred embodiments, a first sealing layer 360 (e.g., butyl seal, sealing caulk, etc.) is placed around the coupling 322 of the anchor member 320 before the underwall 200 is moved into position. This helps create a moisture barrier between the interior surface of the underwall 200 and the adjacent surface of the base 324. After the underwall 200 has been installed relative to the anchor member 320, a second sealing layer 362 (e.g., butyl seal, sealing caulk, etc.) can be placed around the coupling 322.

With continued reference to FIG. 10, the underwall 200 can comprise a first barrier layer 302. For instance, the first barrier layer 302 can be configured to prevent moisture intrusion into an interior portion of the building B (e.g., passing through the underwall 200). In some embodiments, the first barrier layer 302 comprises building paper, tar paper, polyethylene fibril film (e.g. TYVEK®) and/or another film, paper, layer or substance. As illustrated, after the first barrier layer 302 has been placed on the underwall 200, a third sealing layer 364 can be placed on the outside of the first barrier layer 302. In one embodiment, the third sealing layer 364 includes an O-ring butyl seal. However, other types of sealing layers 364 can also be used (e.g., sealing caulk, etc.).

A second barrier layer or system 303 (e.g., building paper, water management system, etc.) can be positioned on the outside of the first barrier layer 302 and third sealing layer 364. In other embodiments, other intermediate or finishing layers, films, coatings or the like can be included, either in lieu of or in addition to the items illustrated and discussed herein. For example, additional barrier layers (e.g., water resistant films, sealants, coatings, etc.) thermal insulation, structural reinforcement, building finish and/or the like can be provided.

As illustrated in FIG. 10, the anchoring system 300 and the various layers located near the exterior portion of the building B are configured to provide an opening 330 through which the coupling 322 of the anchor member 320 can be accessed and engaged. Consequently, a connecting member 140 can be coupled to the anchor member 320 to connect a scaffold assembly or other peripheral structure to the building B. Individual connector members 140 can be engaged and/or disengaged from the corresponding anchor members 320 to provide access to the exterior surface of the building B as needed or desired.

One or more different types of connections can be used to engage the anchor member 320 to the scaffold connecting member 140. The connections can be mechanical and/or non-mechanical as needed or desired. For example, the anchoring systems can comprise threaded connections, bayonet mounts, ball and socket joint, hinges, lock rings, pin systems (e.g., cotter pin), swaging connections, tabbed connections, adhesive couplings or other types of mechanical connections. In other embodiments, adhesives and other types of bonding connections can be used.

After the scaffold assembly or other peripheral structure is no longer needed, it can be removed, along with any connector members 140 coupled to the corresponding anchor members 320. In order to enhance aesthetics and further prevent moisture intrusion into the building B, the opening 330 in the underwall 200 (and the cavity of the coupling 122 situated therein) can be covered (please see FIG. 2).

Figure 11A:
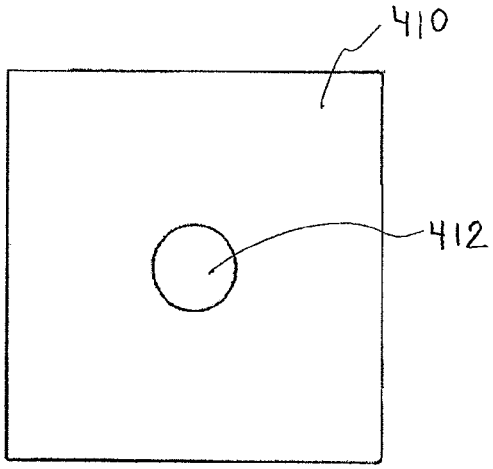
FIG. 11A illustrates a front elevation view of one embodiment of an attachment plate configured to support a scaffold anchor member from the edge of concrete slab.
Figure 11B:
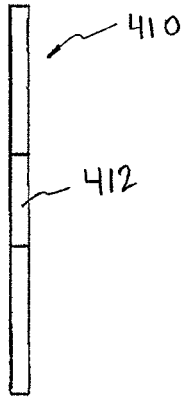
FIG. 11B illustrates a schematic and partial side cross-sectional view of the attachment plate of FIG. 11A.

FIGS. 11A and 11B illustrate an embodiment of an attachment plate 410 configured to be connected to a concrete slab or other structural component of a building B. The depicted attachment plate 410 has a generally rectangular (e.g., square) outer shape. In addition, as shown, the center of the plate 410 includes a circular opening 412 which is configured to receive an anchor bolt or other fastener. In some embodiments, the attachment plate 410 is constructed of ¼ inch thick Grade A366 steel and is 4 inches wide by 4 inches tall. Further, the center opening 412 is approximately 13/16-inch in diameter. In other embodiments, the size, shape, dimensions, opening size, shape and location, material of construction and other characteristics of the attachment plate 410 can vary.

Figure 12:
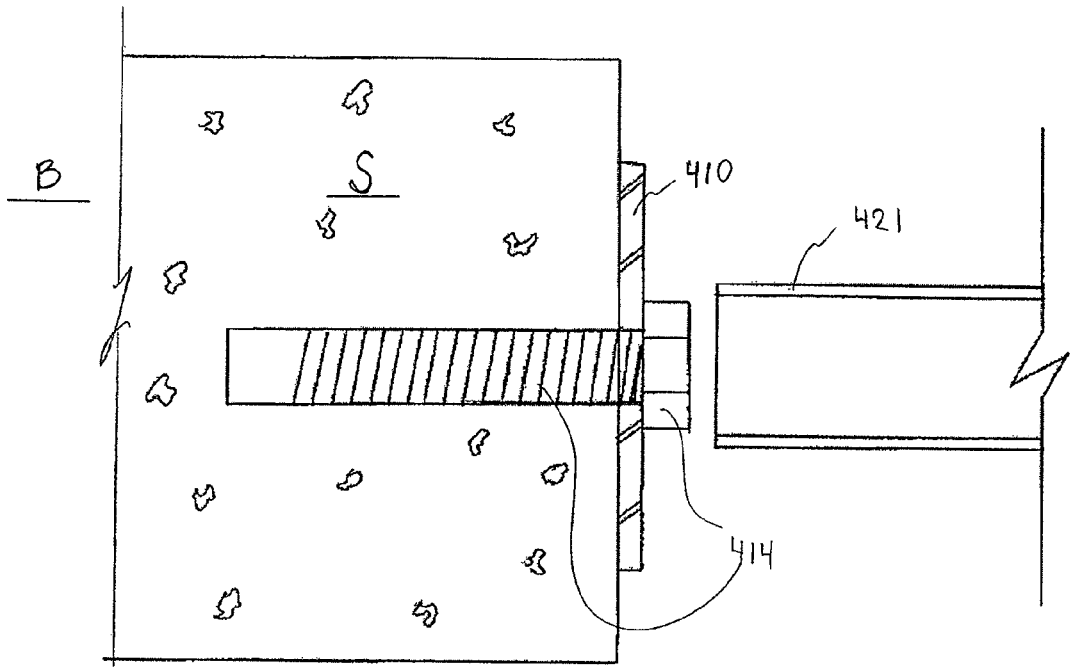
FIG. 12 illustrates the attachment plate of FIGS. 11A and 11B secured to a concrete slab using an anchor bolt in accordance with one embodiment.

In FIG. 12, the attachment plate 410 depicted in FIGS. 11A and 11B is shown attached to a concrete slab S. As illustrated, an anchor bolt 414 or other fastener can be used to secure the attachment plate 410 to the adjacent slab S. Thus, once installed, the attachment plate 410 provides a metal surface to which an anchor support 421 or other portion of an anchor member can attach. This may be desirable when no metal surface (e.g., a steel bent plate 306, as illustrated in FIG. 9) is available.

With continued reference to FIG. 12, a hollow anchor support 421 or other member can be placed over the head of the anchor bolt and welded to the attachment plate 410. In other embodiments, the anchor support 421 is connected to the attachment plate 410 using one or more other connection devices or methods. Consequently, an anchor member (not shown) can be rigidly attached to the anchor support 421 to provide a secure attachment location for a scaffold connection member (not shown).

In some or all of the above embodiments, the scaffold anchoring system can be configured so that its anchor member and/or other portion remain securely attached to a building, even after the scaffold assembly and the connection members have been removed. However, in other embodiments, the anchoring system can be configured to be removed after the scaffold assembly or other peripheral structure has been removed.

Figure 13:
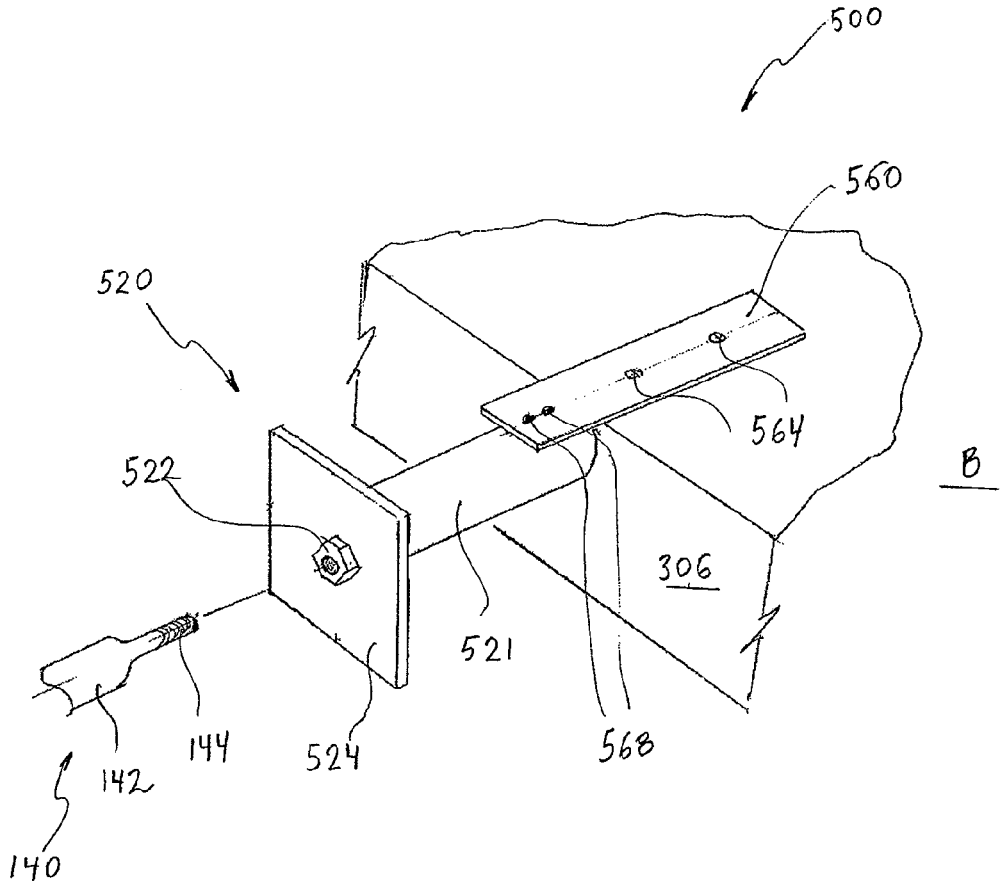
FIG. 13 illustrates a perspective view of a temporary or removable scaffold anchoring system in accordance with one embodiment.
Figure 14:
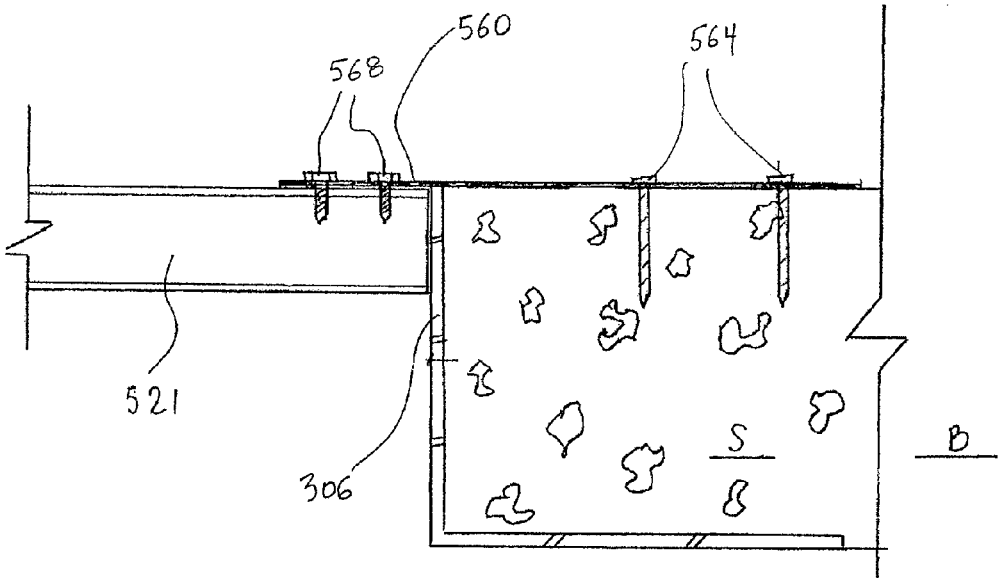
FIG. 14 illustrates a schematic and partial cross-sectional view of the scaffold anchoring system of FIG. 13.

FIGS. 13 and 14 illustrate another modification of the scaffold anchoring system 100 which is referred to generally by the reference numeral 500. The anchoring system 500 can include the same or similar components as the anchoring systems 100, 100A, 100B, 300 except as noted below. Some of the components of the anchoring system 500 that can be similar or the same as the corresponding components of the anchoring systems 100, 100A, 100B, 300 are identified with the same reference numerals and some are identified with unique reference numerals.

The scaffold anchoring system 500 can be configured to be temporary or removable. Similar to other embodiments described herein, the anchoring system 500 can comprise an anchor member 520, which includes a base 524 and a coupling 524 to which the threaded end portion 144 of a connection member 142 can connect. As discussed, the exact shape, size, configuration and other characteristics of the base 524 and/or the coupling 522 can be different than illustrated in FIGS. 13 and 14.

With continued reference to FIGS. 13 and 14, the illustrated embodiment includes an anchor support 521 or other member than extends rearwardly (toward the building B). As shown, the anchor support 521 is attached to an interface member 560 which is configured to attach to an adjacent structural component of the building B (e.g., concrete slab, structural steel member, steel bent plate, etc.). The interface member 560 can comprise a steel or other rigid bar, plate, angle or other structural shape capable of withstanding the forces and moments to which it will be subjected.

In the illustrated embodiment, the anchor support 521 is joined to the interface member 560 using two bolts 568 or other fasteners. However, depending on the particular application, additional or fewer connection points between the members 521, 560 may be required. In alternative embodiments, other types of connections can be used to join the anchor support 521 to the interface member 560, either in lieu of or in addition to fasteners and the like. For example, one or more welds, adhesives or the like can be used. In other embodiments, the interface member 560 and the anchor support 521 can be fabricated (e.g., cast) as a single item.

With continued reference to FIG. 14, the anchor support 521 preferably abuts the adjacent surface of the building B. In the illustrated embodiment, the anchor support 521 abuts a steel bent plate 306 situated next to a concrete slab S. The use of such a steel plate 306 or other rigid member can prevent damage to the underlying concrete slab S. As shown, the interface member 560 can then be secured to the concrete slab S or another structurally sound component of the building B (e.g., structural steel, etc.). In the depicted embodiment, two anchor bolts 564 are used to secure the interface member 560 to the concrete slab S. However, depending on the design conditions related to a particular application, more or fewer anchor bolts may be required. In addition, the design conditions can also require one or more other types of fasteners or connection methods.

In use, once the temporary or removable anchoring system 500 has been adequately designed and installed, one or more scaffold connection members 140 can be attached to corresponding anchor members 520. The attachment and detachment of connection members 140 to anchor members 520 is substantially similar to what is described above with respect to other embodiments. However, if the anchor members 520 are no longer required to support a scaffold or other peripheral structure, the temporary anchoring system 500 can be removed. In the illustrated embodiment, the anchoring system 500 is detached from the building B by removing the anchor bolts 564 from the slab S. However, in other embodiments, one or more other steps may be necessary.

For example, after the anchor member 520 is initially temporarily installed in one location with the interface member 560, some other portions of the building can be erected, such as framing for the exterior of the building. After such framing of the building is erected, it may be necessary to shift or shorten the anchor member 520 due to the resulting dimensions, shape, or configuration of the framing. Thus, the interface member 560 can be removed and the anchor member 520 can be adjusted, moved, or shortened, and then again temporarily attached to the building with the interface member 560 or permanently attached to the building with any of the above described techniques. However, other methods or techniques can also be used.

Such an anchoring system 500 can be advantageously reused as long as its various components have not been damaged or otherwise structurally compromised. However, the exact spacing, type, size, connection method to the building and other details may need to be customized to a particular application. This helps ensure that the scaffold assembly is safely and adequately supported during use.

Although these inventions have been disclosed in the context of a certain preferred embodiment and examples, it will be understood by those skilled in the art that the present inventions extend beyond the specifically disclosed embodiment to other alternative embodiments and/or uses of the inventions and obvious modifications and equivalents thereof. In addition, while several variations of the inventions have been shown and described in detail, other modifications, which are within the scope of this invention, will be readily apparent to those of skill in the art based upon this disclosure. It is also contemplated that various combinations or subcombinations of the specific features and aspects of the embodiments or variations can be made and still fall within the scope of the invention. It should be understood that various features and aspects of the disclosed embodiment can be combined with or substituted for one another in order to form varying modes of the disclosed invention. Thus, it is intended that the scope of the present inventions herein-disclosed should not be limited by the particular disclosed embodiments described above.

What is claimed is:

1. A scaffolding system consisting of:

a latticework of members defining at least one platform, connected to a building for supporting workers adjacent to the building;

a base member secured to a structural component of the building;

a coupling member secured to the base member, the coupling member having an internal thread, the base member extending radially outwardly along a rear face of the coupling member forming a flange around the coupling member, the flange being disposed inwardly from, in a separate plane from and adjacent to a position of a final outer finish layer of the building wherein the flange is between the finish layer and an internal layer of the building, the coupling member having a longitudinal length, along an axial direction of the internal thread, that is less than a thickness of the final outer finish layer such that an outer plane of the final outer finish layer extends beyond an outermost portion of the coupling member along the axial direction of the internal thread;

a connecting member having a first end and a second end, the first end having an external thread configured to mate with the internal thread, the second end being attached to the latticework to thereby maintain the latticework in an upright orientation.

2. The scaffolding system of claim 1, wherein the coupling member comprises a socket having the internal thread.

3. The scaffolding system of claim 1, wherein the base member and the coupling member are capable of being connected by at least one weld.

4. The scaffolding system of claim 1, wherein the base member is configured to attach to a steel member of the building.

5. The scaffolding system of claim 4, wherein the base is configured to be welded to a steel member.

6. The scaffolding system of claim 1, wherein the base member is configured to attach to a concrete portion of the building.

7. The scaffolding system of claim 1, wherein the base member is configured to attach to a framing member of the building.

8. The scaffolding system of claim 1, wherein the base member is configured to attach to a portion of the building by using at least one fastener.

9. The scaffolding system of claim 8, wherein the fastener comprises a screw.

10. The scaffolding system of claim 1, wherein the coupling member comprises a hexagonal nut.

11. The scaffolding system of claim 1, wherein the system is configured to be permanently attached to the building.

12. The scaffolding system of claim 1, wherein the system is capable of being joined to an intermediate member configured to attach to a portion of the building.

13. The scaffolding system of claim 1 is further capable of comprising at least one barrier member that at least partially surrounds the coupling member and is capable of being configured to minimize or prevent a migration of substances into an interior of the building from a vicinity of the scaffolding system.

14. The scaffolding system of claim 13, wherein the at least one barrier member comprises an opening capable of being disposed around the coupling member, and the scaffolding system is capable of having a sealant disposed between the at least one barrier member and the coupling member.

* * * * *